US006925995B1

(12) United States Patent
McConnell et al.

(10) Patent No.: US 6,925,995 B1
(45) Date of Patent: Aug. 9, 2005

(54) ARCHERY BOW BREECH DEVICE

(76) Inventors: William R. McConnell, 301 Upper Sand Valley Rd., Jonesborough, TN (US) 37659; C. Harry Stanley, 514 Bays Rd., Rutledge, TN (US) 37861

( * ) Notice: Subject to any disclaimer, the term of this patent is extended or adjusted under 35 U.S.C. 154(b) by 0 days.

(21) Appl. No.: 10/824,558

(22) Filed: Apr. 14, 2004

Related U.S. Application Data

(63) Continuation-in-part of application No. 10/616,792, filed on Jul. 10, 2003, now abandoned.

(51) Int. Cl.[7] ..... F41B 5/18
(52) U.S. Cl. ..... 124/35.2
(58) Field of Search ..... 124/35.2

(56) References Cited

U.S. PATENT DOCUMENTS 1,542,159 A * 6/1925 Maxwell ..... 124/35.2
4,860,720 A * 8/1989 Todd ..... 124/35.2
5,020,508 A * 6/1991 Greene, Jr. ..... 124/35.2
5,365,911 A * 11/1994 Todd ..... 124/35.2
5,566,664 A * 10/1996 Todd ..... 124/35.2
6,173,706 B1 * 1/2001 McConnell ..... 124/35.2
6,481,430 B1 * 11/2002 Lightcap, Jr. ..... 124/35.2

* cited by examiner

*Primary Examiner*—John A. Ricci

(57) ABSTRACT

An archery bow breech structure having a bowstring keeper and a trigger for releasing the drawn bowstring solely by the phyiscal action of the shooter, wherein a spring mechanism is provided which functions to impart a lost motion action to the pull at a preselected drawstring pull force, wherein the trigger is designated to be pulled by the shooter in an axial direction during the lost motion action and as the result of the lost motion movement of the shooters hand rather than by any independent manipulation of the trigger by the shooter fingers.

9 Claims, 8 Drawing Sheets

ARCHERY BOW BREECH DEVICE

This application is a continuation-in-part of application Ser. No. 10/616,792, filed Jul. 10, 2003, now abandoned.

BACKGROUND OF THE INVENTION

1. Field

This invention concerns a unique breech device for archery bows, i.e., for target or hunting bows, especially for compound bows, and particularly concerns a firing mechanism therefore, wherein the bow string is retained by a releasable latch mechanism such as a conventional keeper, which breech device can be quickly removably mounted on the archer's hand (fingers) by a sling device.

2. Prior Art

Heretofore, many bowstring release or firing mechanisms have been proposed, a few of which are shown, for example, in U.S. Pat. Nos. 4,041,926; 5,448,983; 4,567,875; 4,309,975; 4,458,659; and 4,022,181, the disclosures of which are hereby incorporated herein in their entireties. Such mechanisms typically are encumbered in one or more of the aspects of structural complexity, cost of manufacture, dimensionally too large for rapid deployment in the field, difficult to use rapidly and to recock, bulkiness when stored in pockets or the like or when simply being held in the archers hand, lack of smoothness and accuracy in use, excessive physical abuse of the bowstring upon repeated firings, cocking of the mechanism requiring excessive motion by the archer which is visible to game, a partial pull of the trigger cannot easily be retracted where the archer changes his mind not to shoot at that particular instant, or requires too much time to retrieve from a pocket or the like and properly affix to a bowstring.

A more sophisticated firing mechanism is shown in U.S. Pat. No. 6,173,706B1, the disclosure of which is hereby incorporated herein in its entirety. As shown in FIG. 1 of this patent the type of bowstring keeper which is preferred for the present invention is shown as item 54 and the preferred latch arrest shoulder means is shown as roller 29. Also useful with the present invention is the finger sling 80 of this patent and its operation. As will hereinafter become apparent, difficulties in the use of the trigger member 32 in this patent arises from the fact that the trigger is in a form which requires a conscious finger action of squeeze or pull for firing, wherein the finger action is essentially disassociated from the pulling action of the archer which emanates mainly from the archers shoulder and back muscles. This independent finger action generates its own force vectors which typically are not aligned with the archers pull axis and results, for example, in a sideways jerking of the bowstring, albeit of small degree but quite significant to shooting accuracy.

In U.S. Pat. No. 6,481,430B1, a firing mechanism is disclosed which automatically releases the bowstring when a threshold pull force is applied. However, a safety device is required to prevent premature release of the bowstring, which device is particularly necessary in the use of compound bows as will hereinafter be more fully explained, and the archer must manually unlatch the safety device by finger manipulation in order to fire.

OBJECTS OF THE INVENTION

A principal object therefore, of the present invention is to provide a unique trigger mechanism which uses, to a substantial degree, the bowstring pull action of one lateral set of the archers shoulder and back muscles and the bow push action of the other lateral set of the archers shoulder and back muscles, which actions are substantially on the same pull axis, whereby the trigger is moved in an entirely axial direction to fire the bow without generating sideways or other deflection forces which would impair shooting accuracy.

SUMMARY OF THE INVENTION

The above and further objects hereinafter becoming evident have been attained in accordance with the present invention which, in one of its broad embodiments and as viewed and interpreted from the drawings herein, is defined as an archery bow breech structure having a body means with a bowstring keeper device mounted thereon, trigger means axially slidably mounted on said body means, spring means attaching said body means to a hand pull sling means whereby at a predetermined bowstring pull force, e.g., about 16 lbs for a hump pull 52 lbs., the sling means by the shooter a lost motion action will be initiated and said body means, said keeper device and said trigger means will essentially remain in position relative to the bowstring during said lost motion action while said sling means will start to move away axially therefrom and from said bowstring, wherein said trigger means is adapted to be pinched between the thumb and forefinger of the shooters hand which is pulling said sling means during said lost motion action, whereby said trigger means when so pinched will follow said sling means and hand, and wherein shoulder means on said trigger means is adapted either to engage or to disengage a portion of said keeper device as said trigger means is slid axially on said body means during said lost motion action whereby said bowstring will be released from said keeper device. The strength of the spring means tested is such as to require a pull of about 25–30 lbs. to compress the spring to ½ its relaxed length.

A very important aspect of the above summarized invention is that the shooters fingers (includes thumb) do not impart any significant longitudinal or firing pull to the trigger, but only grips the trigger on its sides. The actual pull of the trigger derives from and during the lost motion action generated by the pull force of the sling means by the shooters hand, arm, and mainly shoulder and back muscles. In other words, without the lost motion action, movement of the trigger means would have to result from longitudinal pulling of the trigger means by crooking the fingers, which of course, would generate unwanted lateral forces. With the present invention, the consequent sliding motion of the trigger means to its firing position necessarily is axial to the bowstring draw axis and results solely from the lost motion action.

BRIEF DESCRIPTION OF THE DRAWINGS

The invention will be further understood from the following description and drawings wherein the various structures are not drawn to scale or relative proportions and are intended to illustrate the concepts inherent in the present invention, and wherein.

DETAILED DESCRIPTION

Figure 13:
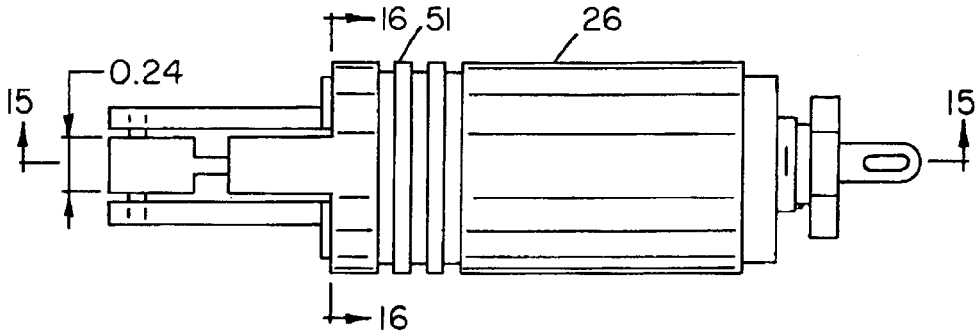
FIG. 13 is a top view of a preferred construction for the present breech.
Figure 14:
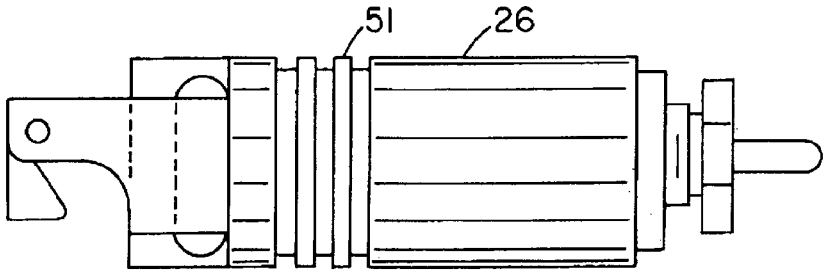
FIG. 14 is a side view of the breech of FIG. 13.
Figure 15:
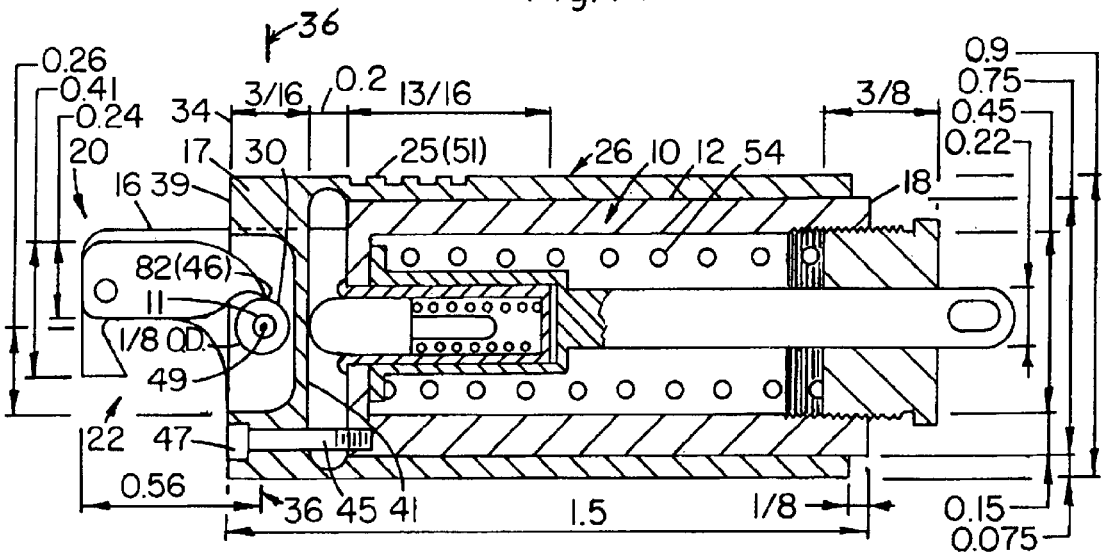
FIG. 15 is a longitudinal cross-section taken generally along line 15—15 in FIG. 13.
Figure 16:
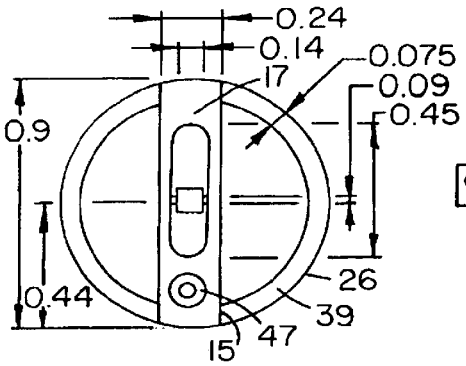
FIG. 16 is distal end view of the isolated trigger slide taken along line 16—16 in FIG. 13.

Referring to the drawings wherein equivalent structures in the various figures are generally numbered the same, and with particular reference to the claims herein, the present bow breech structure comprises body means 10 having an elongated outer surface portion 12, a longitudinal pull axis 14, a front portion 16 and a rear portion 18. A segment 29 of a bow string keeper means, wherein the various parts thereof fall under the general numeral 20, is shaped to provide a keeper notch 25 into which the bowstring is held during bowstring draw. Segment 29 is pivotally mounted on said front portion by pin 27 and is pivotal between a cocked position 22 and a firing position 24 (FIG. 13).

A trigger slide means 26 is slidably mounted on said outer surface portion 12 of said body means and has a finger contact surface 28 adapted to be pinched between the shooters thumb 31 and forefinger 33, or equivalent, when firing is intended. Cooperating first shoulder means 30 is provided on said trigger means and second shoulder means 32 is provided on said keeper means, wherein said trigger means is generally axially movable with respect to and independently of movement of said body means to a first axial position 34 wherein said keeper means can be moved to its cocked position, and further axially movable to a second axial position 36 to engage said first and second shoulder means and release said keeper means to its firing position.

A haft means 38 is mounted on said body means for hand pulling said body means along with a bowstring 40 held by said keeper means 20, wherein said haft means is attached to said body means by a lost motion spring means 42 of increasing or constant reactive force and confined between third shoulder means 21 and fourth shoulder means 23. This spring is selected to impart a desired lost motion action to said haft means at a preselected bowstring pull resistance whereby the relative axial positions of said bowstring, body means, keeper means and trigger means remain substantially fixed during said lost motion action until said trigger means is physically rearwardly moved on said body means by the shooter to said second axial position.

The present inventive concept of employing the combination of a keeper means structure and an axially movable trigger structure which can release the bowstring from the keeper means solely thru axial movement of the trigger means independently of any motion of the body means to which the keeper means is attached, allows the use of any of a large variety of shapes and configurations of the keeper means structure.

Figure 10:
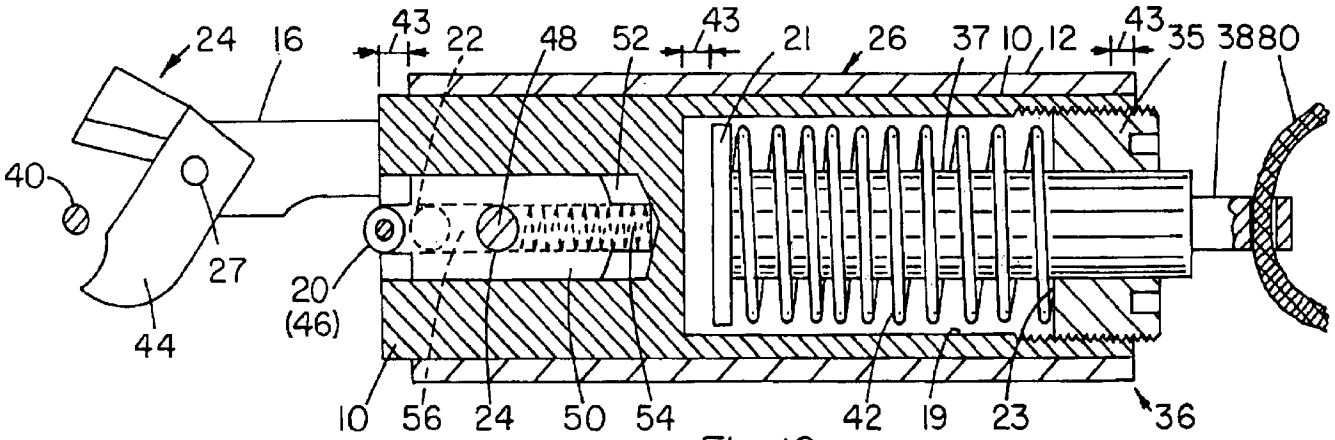
FIG. 10 is a view as in FIG. 4 showing the positions of the device components, the haft means and the trigger means at firing.

For example, in FIGS. 4 thru 9 the keeper means structure employs a keeper segment 44 and roller 46 which are the equivalents of items 46 and 29 respectively of the aforesaid U.S. Pat. No. 6,173,706 B1. However, in FIGS. 4–7 the trigger means or trigger slide 26 is affixed by a pin 48 to a roller support shaft 50 which is slidable in a bearing bore 52 in body means 10. In these embodiments a light compression spring 54 is preferably employed to urge shaft 50 and trigger slide 26 forwardly on body 10 to prevent inopportune disengagement of roller 46 from keeper segment 44. A slot 56 in body 10 allows pin 48 and trigger slide 26 to slide longitudinally of body 10 between cocked position 22 and firing position 24 (FIG. 10).

Figure 1:
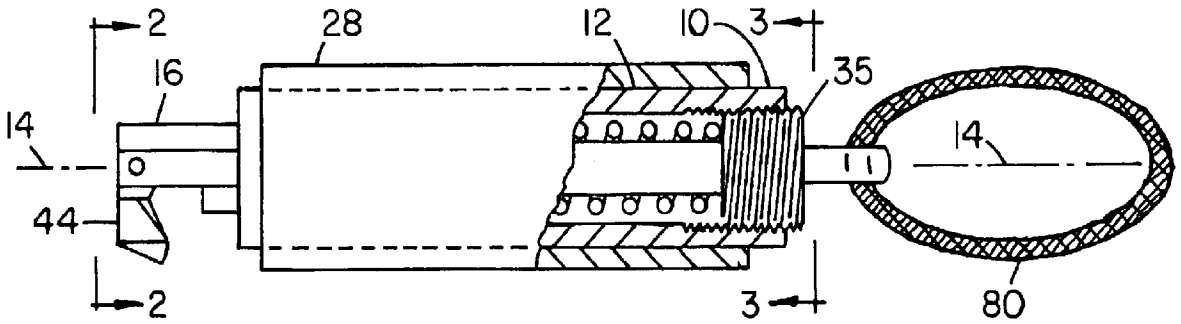
FIG. 1 is a side view, with portions broken away for clarity, of the present breech structure.
Figure 3:
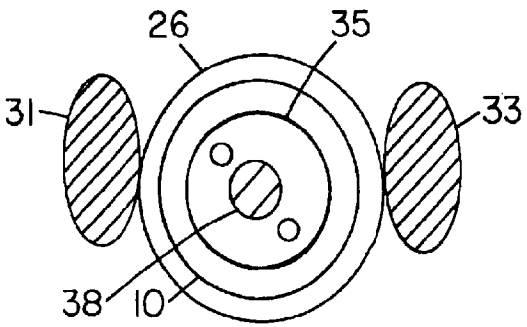
FIG. 3 is a rear view of the breech structure being pinched between a shooters thumb and forefinger.
Figure 2:
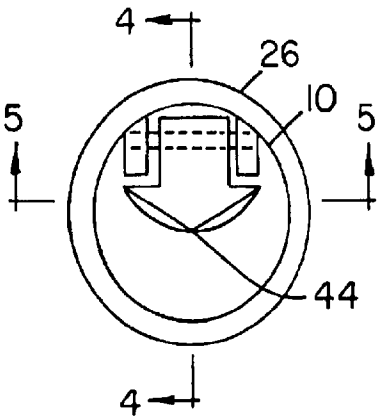
FIG. 2 is an end view taken along line 2—2 in FIG. 1.
Figure 4:
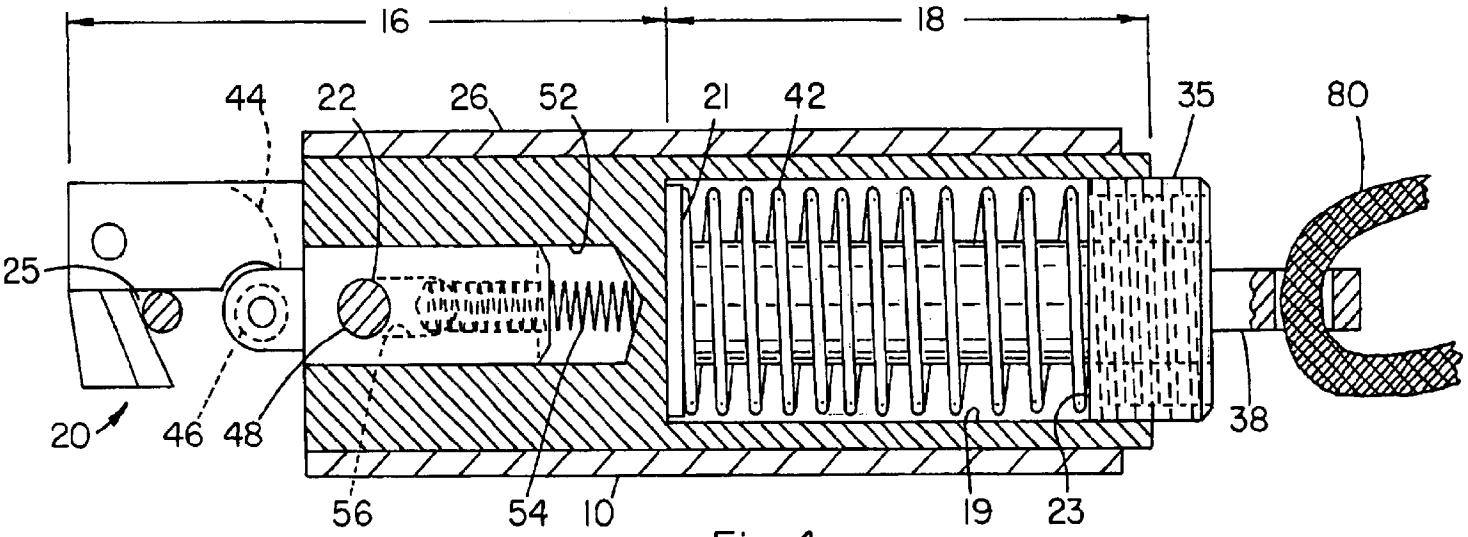
FIG. 4 is a longitudinal cross-sectional view taken generally thru line 4—4 in FIG. 2.
Figure 5:
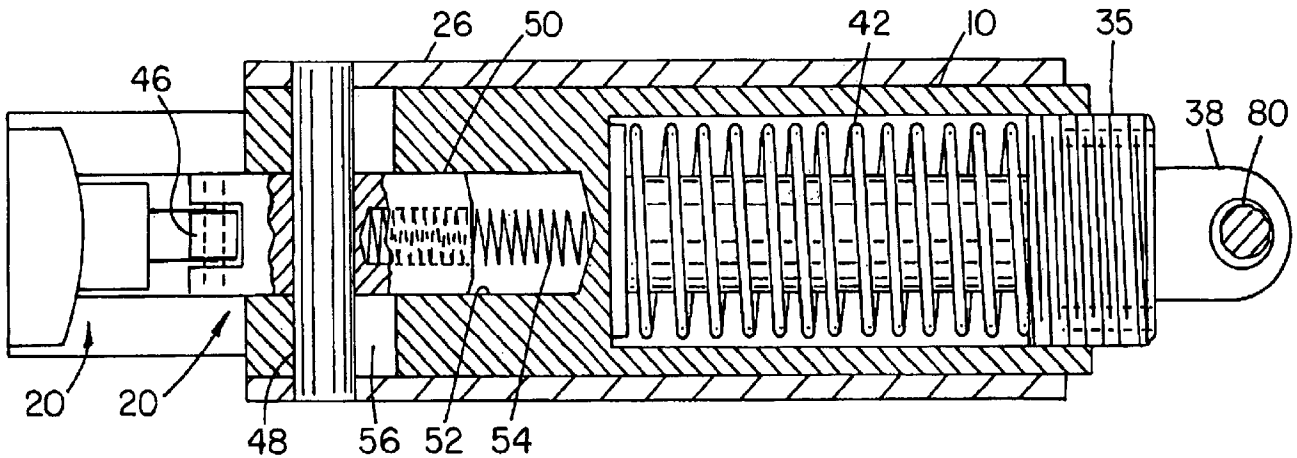
FIG. 5 is a longitudinal cross-sectional view taken generally thru line 5—5 in FIG. 2.
Figures 6, 6A, 7, 8, 8A, 9:
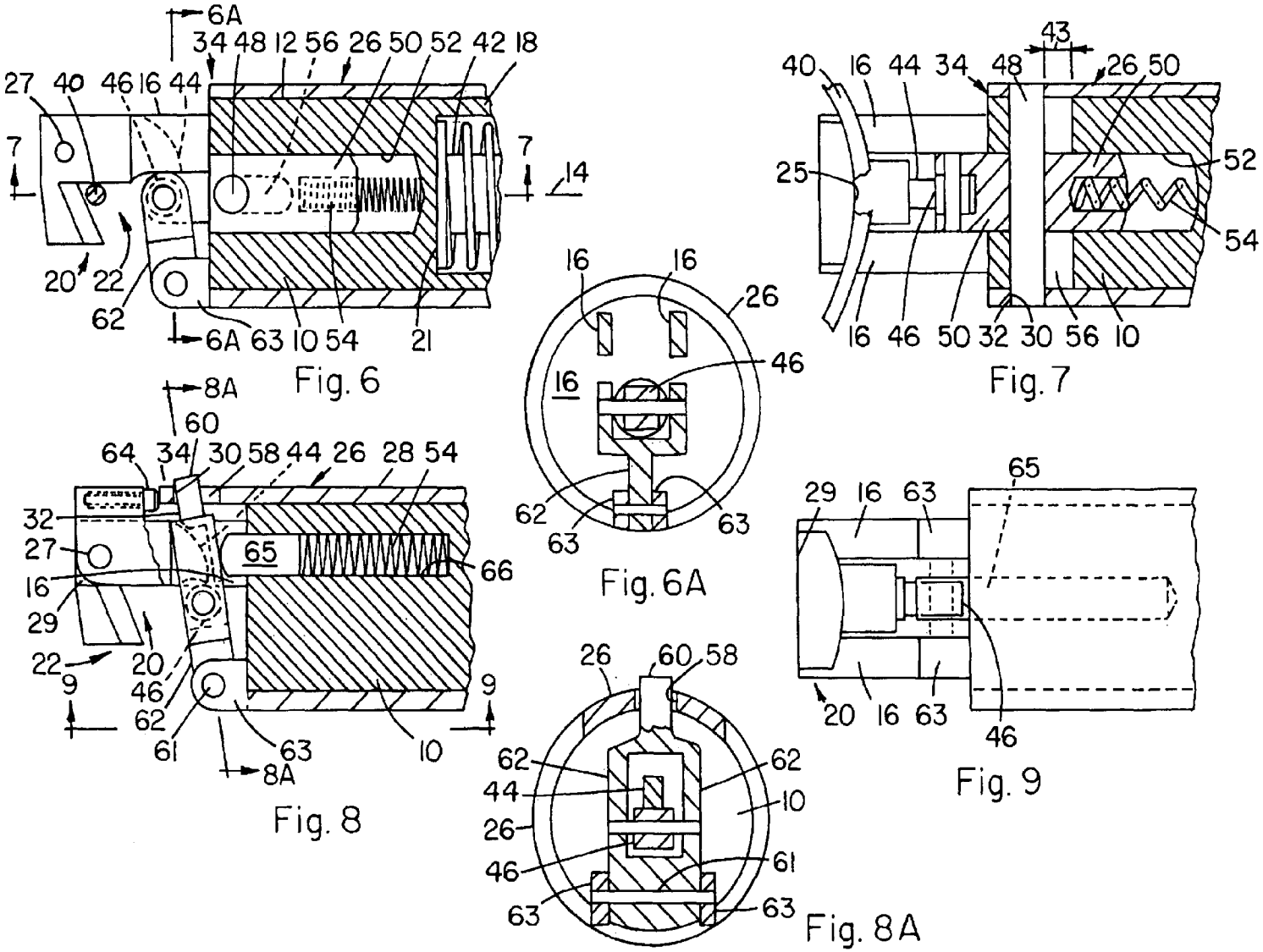
FIG. 6 is a view as in FIG. 4 showing a variation in the device structure.
FIG. 6A is a cross-sectional view taken along line 6A—6A in FIG. 6.
FIG. 7 is a partially sectioned view taken generally along line 7—7 in FIG. 6.
FIG. 8 is a view as in FIG. 6 showing a further variation in device structure.
FIG. 8A is a cross-sectional view taken along line 8A—8A in FIG. 8.
FIG. 9 is a view taken along line 9—9 in FIG. 8.

In FIGS. 8 and 9 trigger slide 26 is not affixed in position to any portion of the keeper means but rather is provided with a slot 58 in which the top portion 60 of roller support arm 62 can longitudinally slide as the arm is rotated on shaft 61 which is mounted in brackets 63 affixed to body 10. In this embodiment, trigger slide 26 is completely free to slide on body 10 within the limits imposed by its engagement with portion 60 of arm 62 at the limits of slot 58. Compression spring 54 urges stud 65 slidably in bore 66 and thus arm 62 and roller 46 toward the cocked position 22 of the keeper means and trigger slide. A trigger adjustment screw such as 64 is threadedly mounted on the front portion 16 of body 10 and is a substantial equivalent of screw 60 in the aforesaid U.S. Pat. No. 6,173,706 B1 patent and can be used with any of the keeper embodiments shown.

Figure 11:
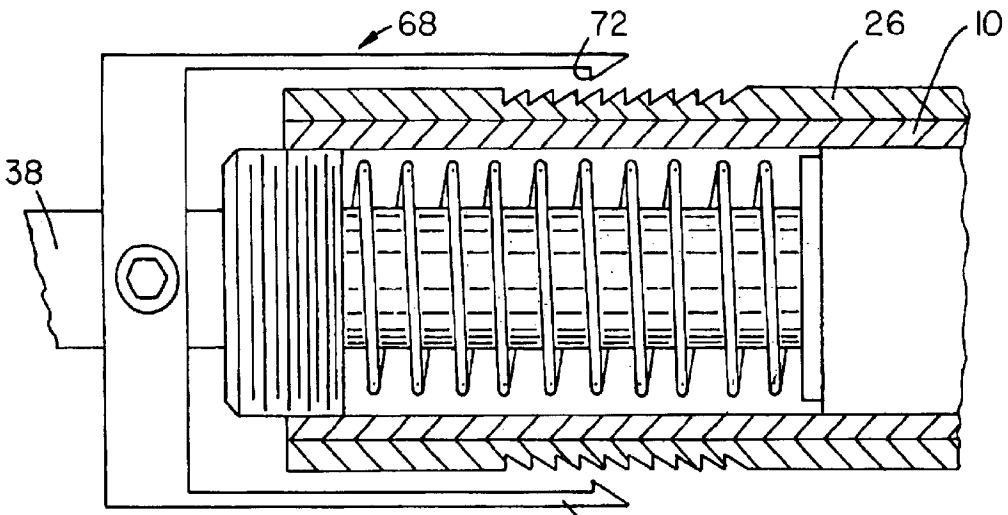
FIG. 11 is a longitudinal cross-section showing the use of a pinching device for use axially moving the trigger means.

Referring to FIG. 11, a gripping means 68 is provided with resilient fingers 70 having barbs 72 adapted to be brought by light finger squeeze pressure into engagement with complimentary barbs 74 on the trigger slide 26. This gripping means may be used to impart a more positive sliding force to the trigger. It is noted that alternatively, slide 26 may be knurled or the like to enhance the frictional grip of the shooter, although no more than a light finger and thumb squeeze is seldom needed.

Figure 12:
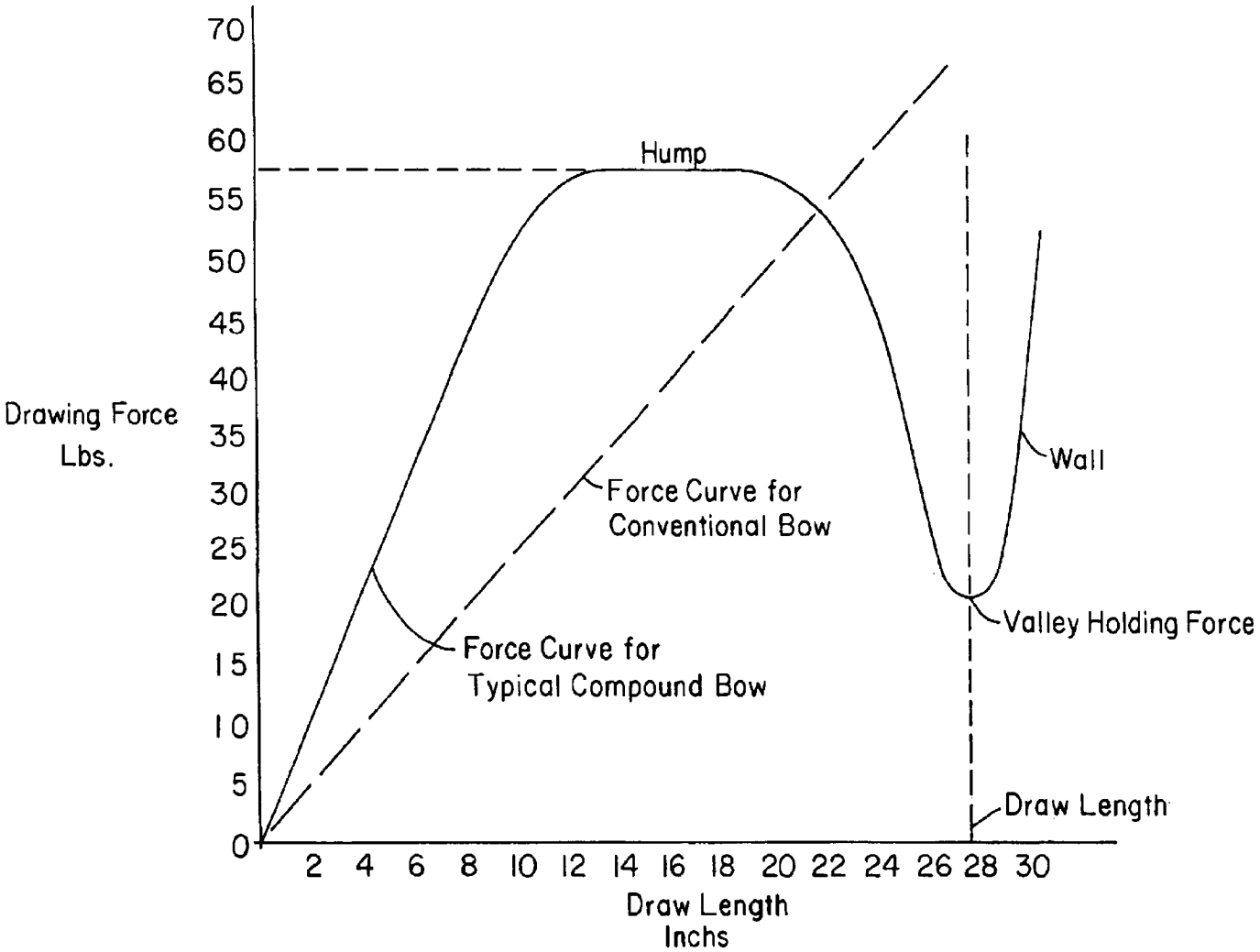
FIG. 12 are bowstring pull force graphs for a conventional bow and for a compound bow, e.g., having a peak draw force of about 52 lbs.

Referring to FIG. 12, the following explanation of the operation of compound bows will further elucidate the significance and uniqueness of the present invention.

Before attempting to understand the principles of operation and the advantages of the present release (trigger means), one must understand the technique used during the final draw and release of the bowstring as well as understand the force-draw curve of a compound bow.

The shooting technique is called "power archer". With this technique a shooter continues to apply draw force to the bowstring, primarily with shoulder and back muscles, while he is aiming at the target, as opposed to simply holding and aiming. During this push and pull activity, the shooter pulls the conventional trigger to release the bowstring. This pushing and pulling tends to prevent creep and allows the shooter to hold more steadily on the target, thus resulting in higher scores. The major problem that occurs when the shooter anticipates pulling the trigger to release the bowstring is that he flinches or jerks which generates lateral forces on the bow and string and causes a poor shot.

Plots of the force-draw curve for a compound bow and conventional bow are shown in FIG. 12. There are three terms that should be noted in particular. The "hump", the "valley" and the "wall". The hump is the first phase of the draw which requires the greatest force, and the force then drops off into the valley. If a shooter attempts to further draw the bow, he is pulling against the wall. At this point the bow cams have run out of travel and the bowstring is pulling directly against heavy bow limbs that are difficult to bend without the leverage of the cams. However, it should be noted that the wall is not completely vertical. During the push and pull activity, the draw length can still be increased slightly because some of the bow's component parts are continuing to bend, stretch or move slightly.

Further to this explanation and to emphasize the difficulties inherent in trigger design with respect to compound bows, in the trigger or release design concept, for example, of the aforesaid U.S. Pat. No. 6,481,430 B1, the bowstring is attached to one end of the release and the shooters drawing hand is attached to the other end of the release. As pull force is applied, a spring inside the release begins to compress. After the spring is compressed by a given prescribed force, the shaft thru the spring plus the string keeper will move, allowing the string to be released. The problem with this design is that the spring setting must be higher than the hump force in order to prevent premature and dangerous release. To overcome this problem a hand-actuated lock is built into the release. This lock is actuated before starting to draw the bowstring and then it is released when the draw force is in the valley (full draw). With this lock design, the spring setting must be set slightly above the valley force. The term slightly is an ambiguous amount because the judgement of different archers and at different times makes it difficult to know if the force he is feeling on the string is in the bottom of the valley or up the wall or perhaps up toward the hump by a few pounds.

Stated another way, the potential problem which this condition creates is that if the spring setting is too low when the hand held lock is released, the bowstring will be released prematurely. To overcome this problem, the spring pressure must be set high enough to be sure of no premature release. This situation creates the problem of how high to set the spring tension. The higher the spring pressure setting the more difficult it is for the shooter to accurately aim, push and pull until the bowstring is released. Also, if the shooter decides that he does not want to shoot after he has reached full draw, the lock must be engaged before the bow can be let down without accidentally releasing the bowstring.

In applicants design however, when near maximum draw force is applied to the breech, only the lost motion spring compresses and no parts of the keeper or trigger move until the shooter pinches the trigger slide. The draw force which initiates the lost motion action can be set, by screwing bushing nut 35 further in or out of body 10, at whatever force the shooter desires, but typically at the valley pressure (or force) or slightly lower without any chance of causing accidental release. There is no need for a locking mechanism and the bow can be let down at anytime as if the bowstring were being held with one's fingers.

To use the present release, after the lost motion spring pressure has been properly set, the string keeper is hooked onto the bowstring. Once the bow has been drawn to full draw and the lost motion action has begun, and while the aiming process is in progress, the trigger slide is lightly pinched between the thumb and forefinger of the pulling hand. As the push, pulling and aiming process continues during the lost motion period the pinched trigger slide will move rearwardly on body 10 until the bowstring is released. This process which results in firing only during the lost motion period ensures a near perfect axial pull at the moment of surprise release, without sideways deflection or jerking of the bowstring or other bow components.

In FIGS. 13 thru 27, structures which are the same as or the equivalent in function to those shown in FIGS. 1–12 are numbered the same, where practical. It is noted that the general body of barrel structure 10, spring means 42, shaft portion 37, bushing nut 35, haft means 38 and finger sling 80 which provide for the lost motion action 43 are substantially the same in all of the embodiments shown in the drawings.

Referring to the embodiment of FIGS. 13–16 and to claim 6 herein the breech structure comprises body means 19 having an elongated outer surface portion 12, a longitudinal pull axis 14, a front (distal) portion 16 and a rear (proximal) portion 18, bow string keeper means 20 mounted on said front portion and movable between a cocked position 22 and a firing position 24, trigger means 26 slidably mounted on said outer surface portion 12 of said body means and having a finger contact surface 28, cooperating shoulder means 30 on said trigger means and shoulder means 46 on said keeper means, said trigger means 26 being generally axially movable relative to and independently of said body means to a first axial position 34 wherein said keeper means 20 can be moved to its cocked position 22, and further axially movable to a second axial position 36 to cause said first 30 and second shoulder means 46 to release said keeper means to its firing position 24, and haft means 38 mounted on said body means 10 for hand pulling said body means along with a bowstring held by said keeper means, wherein said haft means 38 is attached to said body means by spring means 42 selected to impart a desired lost motion action 43 to said haft means 38 at a preselected bowstring draw force whereby the relative axial positions of said bowstring, body means, keeper means and trigger means remain substantially fixed during said lost motion action until said trigger means 26 is physically moved rearwardly on said body means 10 by the archer to said second axial position 36.

In this embodiment the shoulder means, e.g., roller 30 is mounted on shaft 11 which is pressed into apertures in sides 13 and 15 of a bridge portion 17 protruding axially on the distal end 39 of the trigger slide 26. A proximal surface 41 of portion 17 is in constant contact with a plunger 65 which is urged distally by compression spring 54 to thereby position roller 30 to the cocked position of the keeper structure. The machine screw 45 is threaded into the distal end of body 10 and its head 47 limits the distal motion and position of roller 30 such that the contact tip or shoulder 82 of the keeper means 20 is positioned slightly to the proximal side of the roller axis 49 to provide a hair trigger. Gripping ridges 51 are shown on only portions of the trigger sleeve but, of course, can extend along the full length of sleeve 26.

Figure 17:
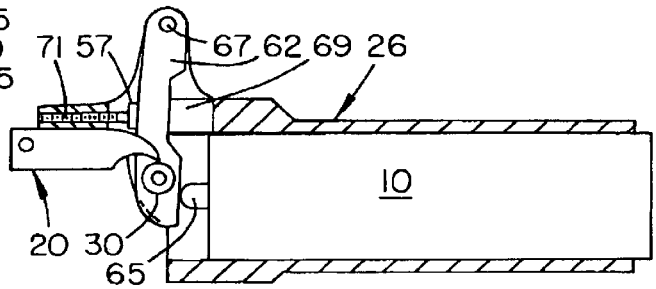
FIG. 17 is a longitudinal cross-sectional view as in FIG. 15, of a further variation of the present breech with the body (barrel) not cross-sectioned.
Figure 18:
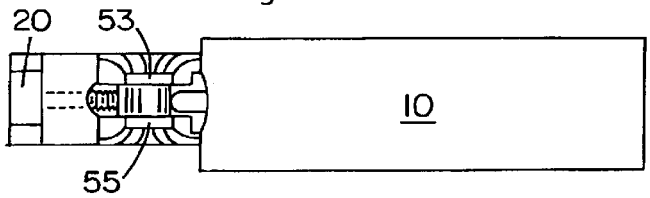
FIG. 18 is a top down view of the isolated body of the breech of FIG. 17.
Figure 19:
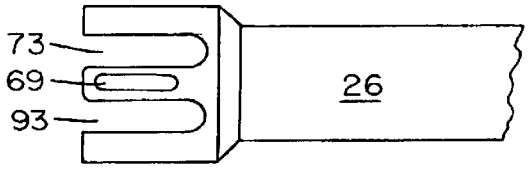
FIG. 19 is a top view of the distal portion of the trigger slide shown in cross-section in FIG. 17.

Referring to FIGS. 17–19, body 10 is provided at its distal end with upstanding supports 53 and 55 between which a roller arm 62 is pivotally mounted by pin 67. This arm is inserted thru a slot 69 in the distal end 57 of sleeve 26. An adjustment screw 71 sets the trigger sensitivity by limiting distal motion of sleeve 26, arm 62 and shoulder means (roller) 30 with respect to contact shoulder 82. Supports 53 and 55 slide thru slots 73 and 93 respectively in sleeve 26.

Figure 20:
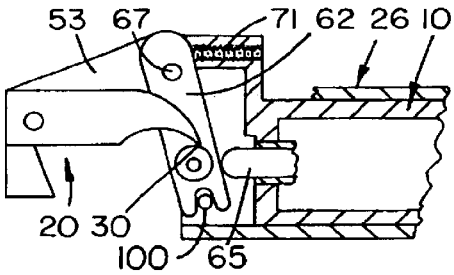
FIG. 20 is a longitudinal cross-section as in FIG. 15 of the distal end portion of another variation of the present breech.
Figure 21:
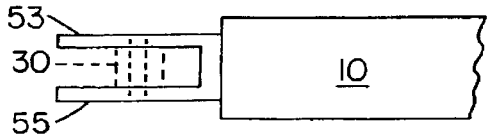
FIG. 21 is a top down view of the body of the breech of FIG. 20 showing only the relative position of the roller in dotted line.
Figure 22:
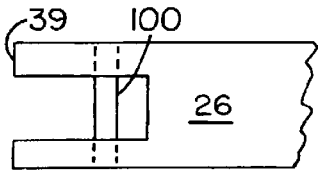
FIG. 22 is a top down view of the trigger slide of FIG. 20 showing the position of the roller arm retracting pin mounted thru the sides of the trigger slide.
Figure 23:
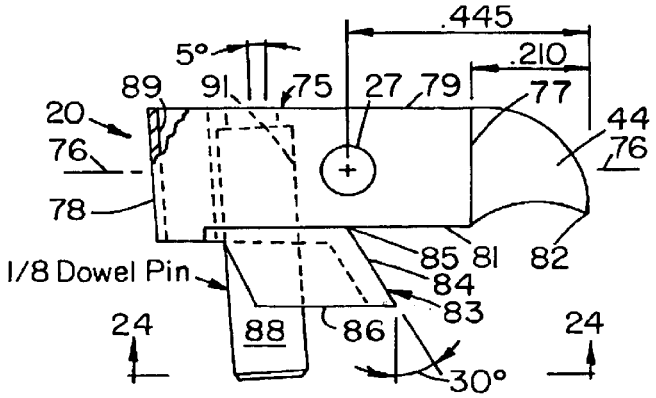
FIG. 23 is a side view of a preferred structure of a bowstring keeper.
Figure 25:
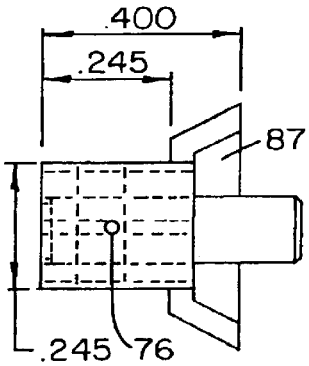
FIG. 25 is an end on view taken along line 25—25 in FIG. 24.
Figure 24:
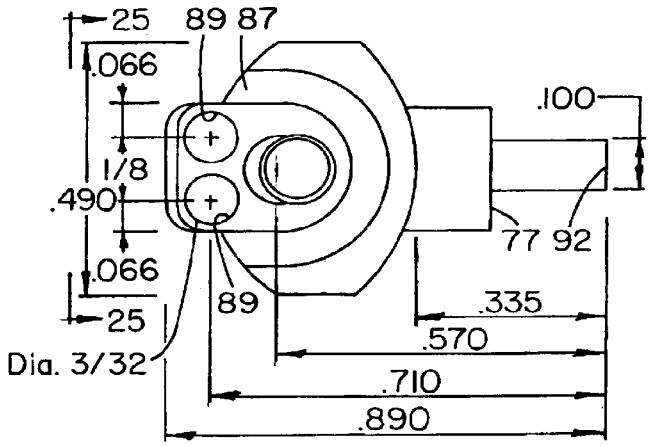
FIG. 24 is a bottom up view taken along line 24—24 of FIG. 23.
Figure 26:
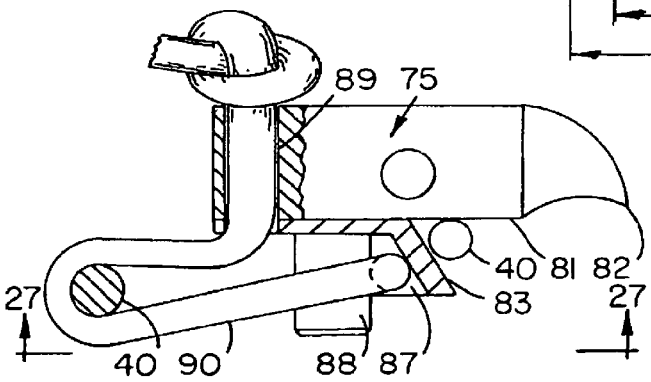
FIG. 26 is a side view, partially sectioned, of the keeper means of FIG. 23 showing the use and positioning of a keeper loop.
Figure 27:
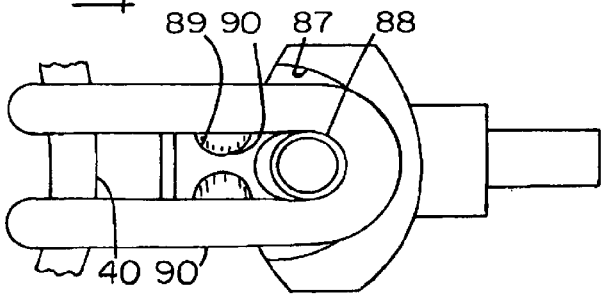
FIG. 27 is a bottom up view taken along line 27—27 in FIG. 26.

Referring to FIGS. 20–22, supports equivalent in function to 53 and 55 pivotally support arm 62 at 67. A pin 100 is pressed thru side portions 101 and 102 of the distal end of sleeve 26 and is nested in a recess in the lower end 103 of arm 62. Retraction of sleeve 26 upon firing pivots arm 62 and roller to the firing position.

Referring to FIGS. 23–27, a most preferred keeper costruction embodiment is shown, and wherein, the structure comprises a base 75 having a longitudinal axis 76, a proximal end 77, a distal end 78, top surface 79, a bottom surface 81, and a keeper segment 44 extending longitudinally from said proximal end and providing a contact shoulder 82 downwardly facing, bowstring hooking wall means 83 extending generally downwardly from said bottom surface 81 and having a bowstring hooking surface 84 slanting longitudinally toward said proximal end 77 at an angle to said axis 76 of from about 20° to about 40° to provide a keeper notch 85, said wall means 83 having a bottom edge 86 and being curved generally concavely in a distal direction to provide a distally opening cavity 87, a keeper post 88 extending generally downwardly thru said cavity 87 from said bottom surface 86 and slanting longitudinally toward said proximal end 77 at an angle to said axis 76 of from about 2° to about 30°, and said base further having tether tie means 89 to which a keeper loop 90 can be attached. The contact shoulder 82 preferably is a sharp edge 92 and the tie means 89 preferably comprises a side-by-side pair of apertures extending thru said base from said bottom surface 81 to said top surface 79.

The invention has been described in detail with particular reference to preferred embodiments thereof, but it will be understood that variations and modifications will be effected with the spirit and scope of the invention.

We claim:

1. An archery bow breech structure comprising body means having an elongated outer surface portion, a longitudinal pull axis, a front portion and a rear portion, bow string keeper means mounted on said front portion and movable between a cocked position and a firing position, trigger means slidably mounted on said outer surface portion of said body means and having a finger contact surface, cooperating first shoulder means on said trigger means and second shoulder means on said keeper means, said trigger means being generally axially movable relative to and independently of said body means to a first axial position wherein said keeper means can be moved to its cocked position, and further axially movable to a second axial position to engage said first and second shoulder means and release said keeper means to its firing position, and haft means mounted on said body means for hand pulling said body means along with a bowstring held by said keeper means, wherein said haft means is attached to said body means by spring means selected to impart a desired lost motion action to said haft means at a preselected bowstring draw force whereby the relative axial positions of said bowstring, body means, keeper means and trigger means remain substantially fixed during said lost motion action until said trigger means is physically moved rearwardly on said body means by the archer to said second axial position.

2. The breech structure of claim 1 wherein said trigger means is cylindrical in shape and is readily axially slidably mounted on said body means between said cocked and firing positions, said rear portion of said body means is provided with a first axial bore, said haft means has a shaft portion slidably mounted in said first axial bore, said spring means comprises a compression spring retained in said first axial bore between third shoulder means on said shaft portion and fourth shoulder means on said body means wherein said spring urges said haft means toward its real time (not lost motion) draw position on said body means.

3. The breech structure of claim 2 wherein said front portion of said body means is provided with a second axial bore, a shaft portion of said keeper means is slidably mounted in said second axial bore, said second shoulder means on said keeper means being provided on said shaft portion and extending laterally beyond said outer surface portion of said body means, compression spring means in said second axial bore and urging said shaft portion and second shoulder means toward the cocked position of said keeper means.

4. The breech structure of claim 3 wherein a keeper notch on said keeper means, said first axial bore and said second axial bore all lie on substantially the same longitudinal axis.

5. The breech structure of claim 2 wherein said fourth shoulder means is provided by bushing means threadedly mounted in the rear opening of said first axial bore and adjustable axially thru said opening to vary said preselected bowstring draw force, and wherein said shaft portion of said haft means is slidably mounted thru an opening formed generally axially thru said bushing means.

6. The breech structure of claim 1 wherein said second shoulder means comprises a roller mounted on an arm which is pivotally mounted on said body means, and wherein said first shoulder means is fixed on said trigger means.

7. The breech structure of claim 1 wherein said first shoulder means comprises a roller mounted on said distal portion of said sleeve means, and wherein said second shoulder means comprises a contact shoulder on said keeper means.

8. The breech structure of claim 1 wherein cooperating structural elements of trigger sensitivity adjustments are provided on said breech structure for setting the relative axial positions of said first and second shoulder means.

9. An archery bow breech structure comprising body means 10 having an elongated outer surface portion 12, a longitudinal pull axis 14, a front portion 16 and a rear portion 18, bow string keeper means 20 mounted on said front portion 16 and movable between a cocked position 22 and a firing position 24, trigger means 26 slidably mounted on said outer surface portion 12 of said body means and having a finger contact surface 28, cooperating shoulder means 30 on said trigger means and shoulder means 46 on said keeper means, said trigger means 26 being generally axially movable relative to and independently of said body means to a first axial position 34 wherein said keeper means 20 can be moved to its cocked position 22, and further axially movable to a second axial position 36 to cause said first 30 and second shoulder means 46 to release said keeper means to its firing position 24, and haft means 38 mounted on said body means 10 for hand pulling said body means along with a bowstring held by said keeper means, wherein said haft means 38 is attached to said body means by spring means 42 selected to impart a desired lost motion action 43 to said haft means 38 at a preselected bowstring drew force whereby the relative axial positions of said bowstring, body means, keeper means and trigger means remain substantially fixed during said lost motion action until said trigger means 26 is physically moved rearwardly on said body means 10 by the archer to said second axial position 36.

* * * * *